US005908438A

United States Patent [19]

Múñoz et al.

[11] Patent Number: 5,908,438

[45] Date of Patent: Jun. 1, 1999

[54] DOSING FEEDING TEAT

[76] Inventors: Eduardo García Múñoz; Maria Nieves Cabrero Flores; Juan Carlos García Múñoz; Estrella Agudo Rodriguez, all of Plaza Médico Antonio Barbero, 2-4o G, E-03015 Alicante, Spain

[21] Appl. No.: 08/750,940

[22] PCT Filed: Jun. 19, 1996

[86] PCT No.: PCT/ES96/00134

§ 371 Date: Feb. 18, 1997

§ 102(e) Date: Feb. 18, 1997

[87] PCT Pub. No.: WO97/00062

PCT Pub. Date: Jan. 3, 1997

[30] Foreign Application Priority Data

Jun. 19, 1995 [ES] Spain ..... 9501668 U

[51] Int. Cl.[6] ..... A61J 17/00

[52] U.S. Cl. ..... 606/234

[58] Field of Search ..... 606/234–236

[56] References Cited

U.S. PATENT DOCUMENTS 5,620,462 4/1997 Valenti ..... 606/234

FOREIGN PATENT DOCUMENTS

| | | | |
|---|---|---|---|
| 0019385 | 1/1936 | Australia | 606/234 |
| 0300783 | 1/1989 | European Pat. Off. . | |
| 266142 | 1/1963 | Spain . | |
| 266184 | 5/1982 | Spain . | |
| 2044612 | 7/1992 | Spain . | |
| 0261502 | 8/1949 | Switzerland | 606/234 |

*Primary Examiner*—Michael Buiz
*Assistant Examiner*—William W. Lewis
*Attorney, Agent, or Firm*—Robert M. Schwartz

[57] ABSTRACT

Dosing feeding teat intended to dispense to the suckling child small doses of food, medicines or mixtures of both, having a perforated nipple with conventional protection ring to which is added at the opposite extremity an extraction feeding bottle made of elastic material, to which is incorporated subsequently the protection ring, the latter being provided with a container for humidifying the nipple, with planar base, similar to that of the doser.

4 Claims, 1 Drawing Sheet

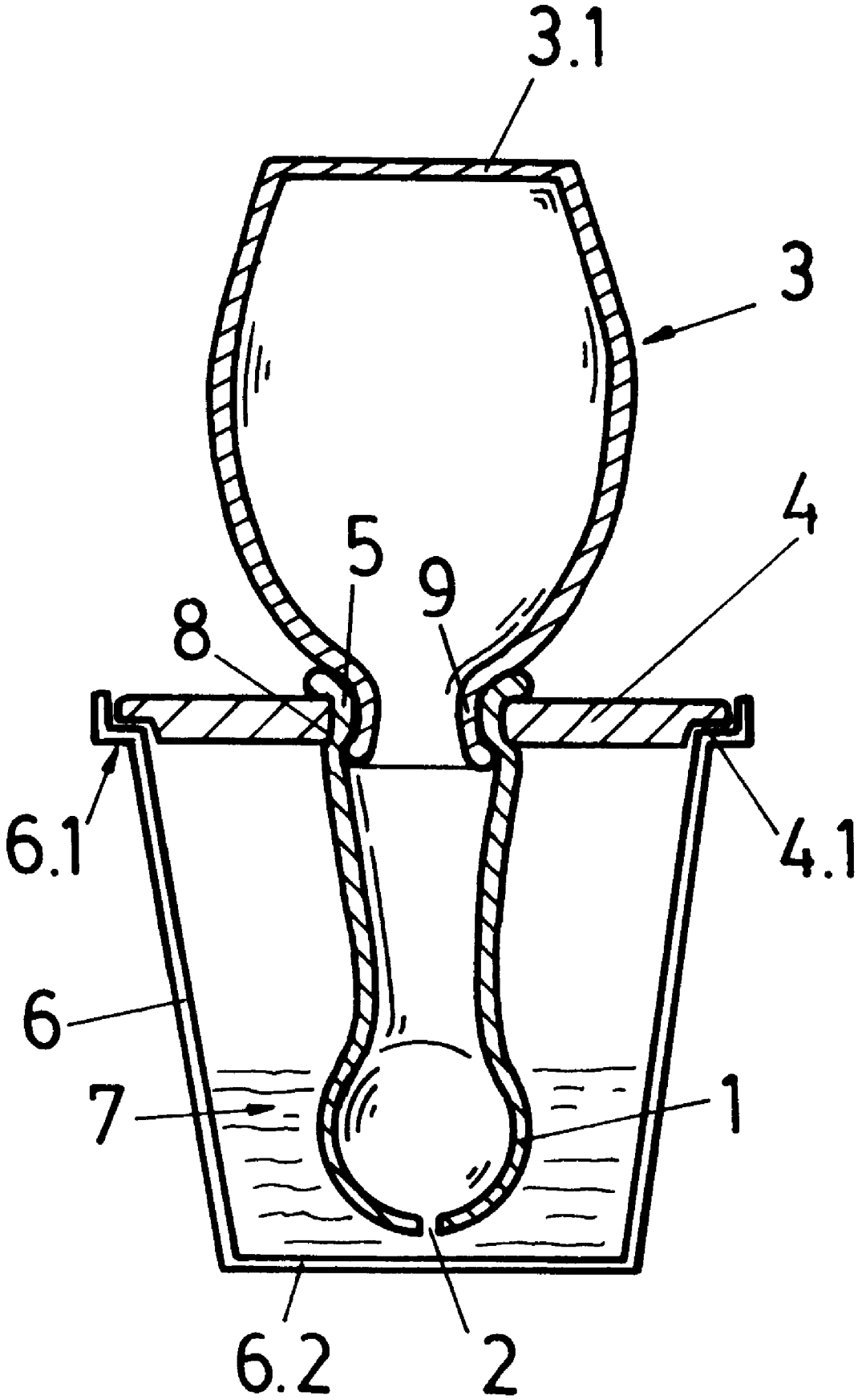
3.1
3
4
5
9
8
6.1
4.1
6
7
1
6.2
2

DOSING FEEDING TEAT

DESCRIPTION

BACKGROUND OF THE INVENTION

Feeding teats in multiple shapes and sizes are well known and therefore require no further description.

The same applies to aspirating bulbs, particularly used for nose cleaning of children.

Conventional feeding bottles, filled through one end and comprising a rigid body which holds the liquid or pasty product to be fed, are usually fitted with an intermediate membrane located between the container and the teat.

Other feeding bottles are filled through small holes and projections in a cup.

The applicant is not aware of the existence of a combination teat and extraction bottle forming a medicine or food dosing device, and much less that said article is fitted with a container coupled onto the ring which keeps the teat wet, and neither that it is further capable of standing upright on both the base of the container and the base of the feeding bottle.

SUMMARY OF THE INVENTION

The invention described in the present specification refers to a dosing feeding teat designed to provide the suckling, either human or animal, with small doses of nourishment or medicines, or mixtures thereof.

A feeding bottle made of resilient material is attached to a conventional perforated nipple fitted with a protective ring, or else a large complete elastic element is fabricated to which the protective ring is subsequently incorporated.

This invention is further characterized by the special construction of the ring, provided with a cutout on one side which lodges onto the mouth of a teat protecting and humidifying container.

The container is provided with a flat base, and the feeding bottle being similarly provided with a flat base at the other end, so that the article can be placed is upright.

The proposed invention, involving a dosing feeding teat, is composed of a single or double piece resilient body fitted with a nipple on one end and a small extraction bottle on the other, separated by a conventional separating ring inserted between corresponding projections on the narrower zone of the nipple.

In use, the food or medicine (or mixture) to be administered to the infant or suckling is placed in a spoon or some similar adequate container.

After extracting the air from the bottle, the dosing teat sucks-in the product.

The infant or suckling is then fed in perfect compliance with minimum hygienic requirements, in a manner fully convenient and practical for the user.

This invention is also characteristic in that the ring—normally made of resilient plastic material and preferably having a circular shape, although other constructions may likewise be considered—is of a special construction, being provided with a cutout on one of its sides.

This cutout lodges on an external graded rim in the mouth of the container, also made of plastic material, said graded rim being dimensioned such that its height and diameter allows for a perfectly tight fit of the resilient material ring and container.

The container is filled with a humidifying product, e.g. water or a mixture of water and feeding bottle or mouth disinfectant, and the nipple is thus kept wet when not in use.

The container is built with a flat base; the feeding bottle attached to the other side of the ring is likewise provided with a flat base. This inventive article can therefore be placed to stand upright in either position.

DESCRIPTION OF THE DRAWING

In order to complement the description set forth and provide a better understanding of the characteristics of the invention, a drawing is attached to this specification, forming an integral part thereof, wherein the following is illustrated with a non-limiting character:

FIG. 1 is a longitudinal cross section of the dosing teat which reflects the improvements of this invention.

PREFERRED EXECUTION OF THE INVENTION

In the light of the above FIGURE, it can be seen that the proposed invention consists of a dosing feeding teat made of resilient material, comprising

- a feeding nipple (1) with a hole (2) in its front end, and with a lateral projection (5) in its inner rear end which has a corresponding outer recess (8),
- a small extraction feeding bottle (3) with a lateral narrow zone (9) in its front end, to which said lateral projection (5) of said feeding nipple (1) is attached,
- a protective container (6) made of plastic material that holds a product (7) for humidifying the feeding nipple (1), having an opening in its upper end with an internal grade rim (6.1),
- a protective ring (4) made of plastic material inserted into said corresponding outer recess of said nipple (1), having a lower cutout (4.1) on its periphery which lodges, in a tight fit, onto said internal graded rim (6.1) of said protective container (6).

The said protective container (6) is provided with a flat base (6.2) enabling the dose feeding teat to be placed upright when said flat base (6.2) is on a resting position.

The said feeding bottle (3) is provided with a flat base (3.1) enabling the dose feeding teat to be placed upright when said flat base (3.1) is on a resting position.

It is likewise understood that, provided the essential nature of the invention is not altered, the materials, shape, size an arrangement of the elements may vary.

The descriptive terms and their meaning must be taken in a non-limiting sense.

We claim:

1. Dosing feeding teat made of resilient material comprising:

- a feeding nipple with a hole in its front end, and with a lateral projection in its inner rear end which has a corresponding outer recess,
- a resilient small extraction feeding bottle with a lateral narrow zone in its frontal end, to which said lateral projection of said feeding nipple is attached,
- a protective container made of plastic material that holds a product for humidifying the feeding nipple, having an opening in its upper end with an internal grade rim, and
- a protective ring made of plastic material inserted into said corresponding outer recess of said nipple, having a lower cutout on its periphery which lodges, in a tight fit, onto said internal graded rim of said protective container, such that a depression of said resilient feeding bottle will cause an extraction of air from said bottle, further causing the teat to suck-in a desired product to be subsequently dosed through said teat.

2. Dosing feeding teat made of resilient material according to claim 1 wherein said protective container is provided with a flat base enabling said dosing feeding teat to be positioned within a humidifying material when said flat base is on a resting position and said protective container holds a humidifying material contained by said protective container and said protective ring.

3. Dosing feeding teat made of resilient material according to claim 2, wherein said feeding bottle is provided with a flat base enabling the dose feeding teat to be placed upright when said flat base is on a resting position.

4. Dosing feeding teat made of resilient material according to claim 1 wherein said feeding bottle receives said desired product without the necessity of separating said feeding bottle from said teat.

* * * * *